US009722299B2

(12) United States Patent
Lin

(10) Patent No.: US 9,722,299 B2
(45) Date of Patent: Aug. 1, 2017

(54) ANTENNA ASSEMBLY, WIRELESS COMMUNICATION DEVICE AND METHOD OF MANUFACTURING SAME

(71) Applicant: FIH (Hong Kong) Limited, Kowloon (HK)

(72) Inventor: Po-Chih Lin, New Taipei (TW)

(73) Assignee: FIH (Hong Kong) Limited, Kowloon (HK)

( * ) Notice: Subject to any disclaimer, the term of this patent is extended or adjusted under 35 U.S.C. 154(b) by 652 days.

(21) Appl. No.: 14/093,062

(22) Filed: Nov. 29, 2013

(65) Prior Publication Data

US 2014/0340266 A1 Nov. 20, 2014

(30) Foreign Application Priority Data

May 16, 2013 (TW) ..... 102117454 A

(51) Int. Cl.
*H01Q 1/24* (2006.01)
*H01Q 9/42* (2006.01)

(52) U.S. Cl.
CPC ..... *H01Q 1/243* (2013.01); *H01Q 9/42* (2013.01); *Y10T 29/49016* (2015.01)

(58) Field of Classification Search
CPC ..... H01Q 1/2258; H01Q 1/2266; H01Q 1/24; H01Q 1/241; H01Q 1/243; H01Q 9/30; H01Q 9/42; H01Q 9/0407; H01Q 9/0421; H01Q 9/045; H01Q 9/0471
See application file for complete search history.

(56) References Cited

U.S. PATENT DOCUMENTS 6,812,899 B2 * 11/2004 Moren ..... H01Q 1/243 343/702
6,853,336 B2 * 2/2005 Asano ..... H01Q 1/22 343/702
6,856,285 B2 * 2/2005 Bettin ..... H01Q 1/243 343/700 MS
7,064,719 B2 * 6/2006 Wu ..... H01Q 1/243 343/702
7,183,980 B2 * 2/2007 Chang ..... H01Q 1/243 343/700 MS
7,626,551 B2 * 12/2009 Chien ..... H01Q 5/371 343/700 MS

FOREIGN PATENT DOCUMENTS

FI WO 2004109847 A1 * 12/2004 ..... H01Q 1/241

* cited by examiner

*Primary Examiner* — Tho G Phan
*Assistant Examiner* — Patrick Holecek
(74) *Attorney, Agent, or Firm* — Steven Reiss

(57) ABSTRACT

An antenna assembly includes a holder having a first surface and a second surface opposite from the first surface. The antenna assembly defines a number of holes through the first surface and the second surface. A number of connectors are correspondingly received and secured in the holes. The connectors includes an elastic thimble portion on one end. An antenna module is formed on the holder. One end of the connectors connects to the antenna module, while the end with elastic thimble protrudes from the second surface for connecting to a circuit board. A wireless communication device employing the antenna assembly and a method of manufacturing the wireless communication device are also disclosed.

4 Claims, 5 Drawing Sheets

ANTENNA ASSEMBLY, WIRELESS COMMUNICATION DEVICE AND METHOD OF MANUFACTURING SAME

BACKGROUND

1. Technical Field

The present disclosure relates to an antenna assembly, a wireless communication device employing the antenna assembly, and a method of manufacturing the wireless communication device.

2. Description of Related Art

Wireless communication devices have antenna modules for transceiving wireless signals. A plurality of pins of the antenna module are electrically connected to a printed circuit board (PCB) of the wireless communication device for feeding signals to and grounding the antenna module. However, the design of the pins can be limited because of limited space in the wireless communication device. In addition, the pins are easily detached from the PCB if the wireless communication device is dropped. Therefore, there is room for improvement in the art.

BRIEF DESCRIPTION OF THE DRAWINGS

Many aspects of the disclosure can be better understood with reference to the following figures. The components in the figures are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
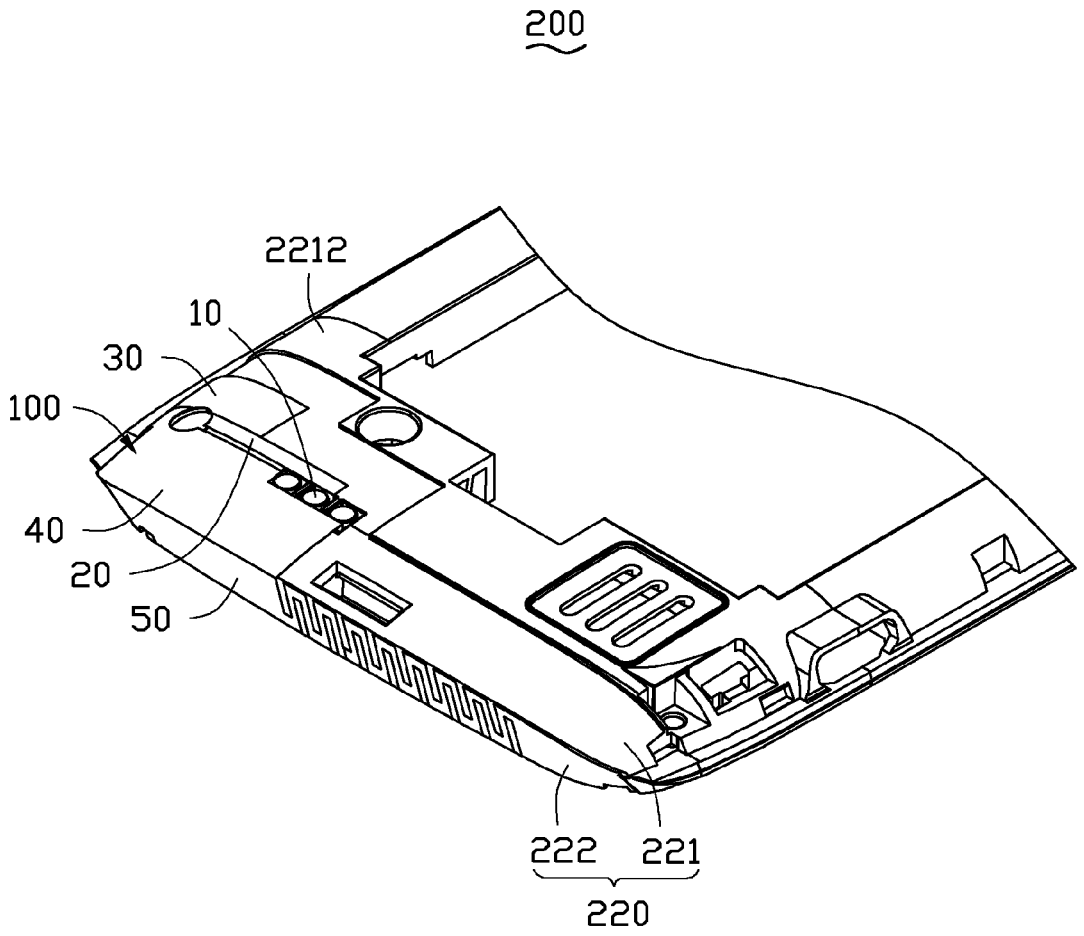
FIG. 1 is an isometric view of an exemplary embodiment of a wireless communication device employing an antenna module.
Figure 2:
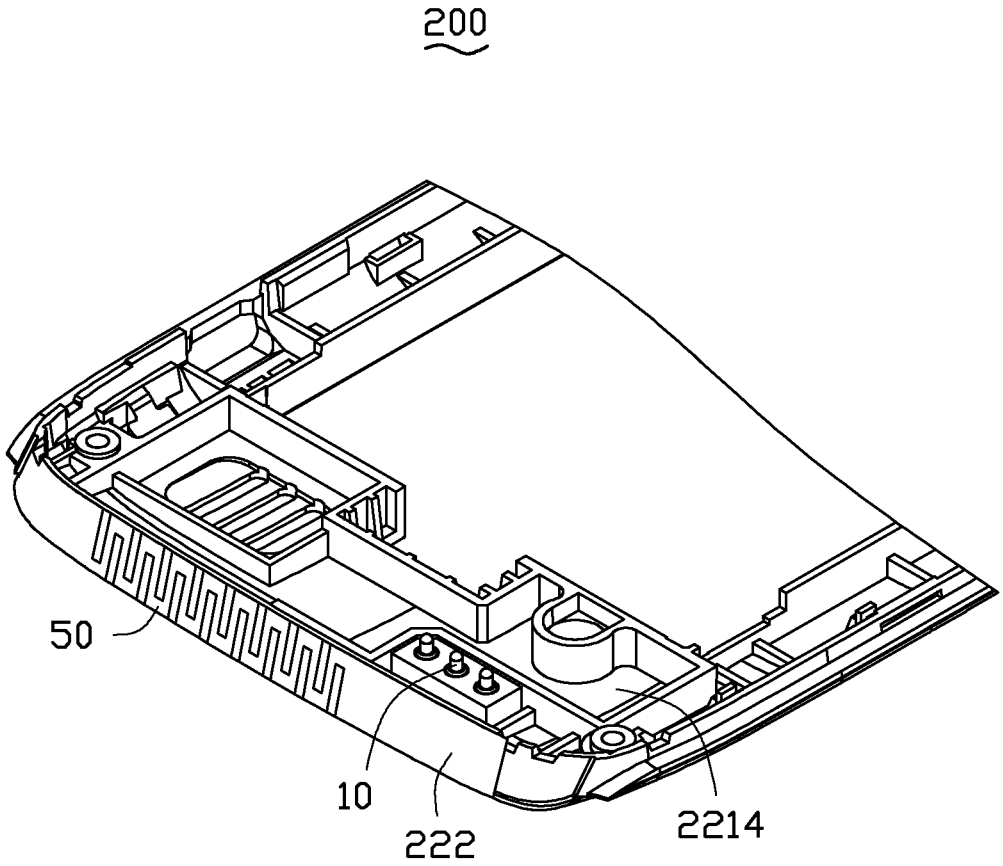
FIG. 2 is similar to FIG. 1, but viewed from another aspect.
Figure 3:
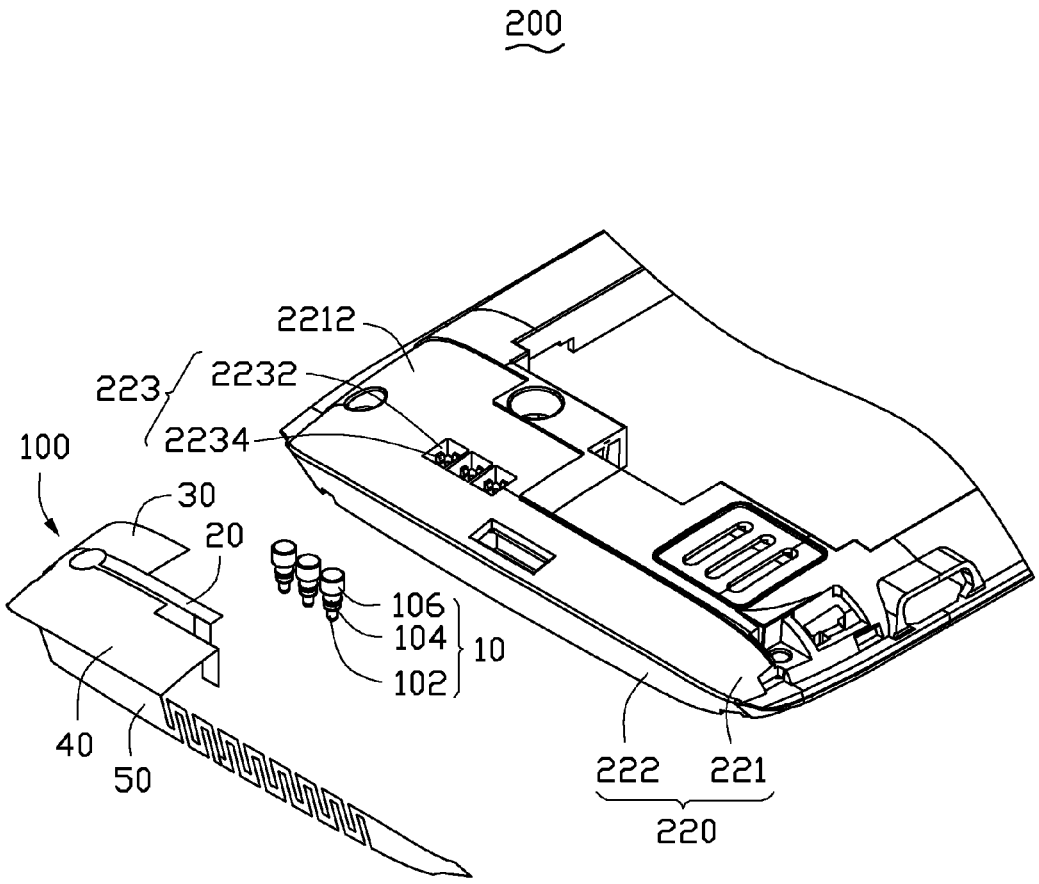
FIG. 3 is an exploded view of the wireless communication device of FIG. 1.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

FIG. 1 through FIG. 5 show an exemplary embodiment of a wireless communication device 200 employing an antenna module 40. The wireless communication device 200 is an electronic device, such as a mobile phone, a tablet computer, or a notebook computer.

The wireless communication device 200 includes a housing 220. The housing 220 is made of non-conductive material. The housing 220 includes a bottom wall 221 and a sidewall 222 arcuately connected to the bottom wall 221. The bottom wall 221 includes a first surface 2212 and a second surface 2214 opposite to the first surface 2212. A plurality of holes 223 is defined through the first surface 2212 and the second surface 2214. The holes 223 are arranged linearly. In one embodiment, each hole 223 is substantially square. Furthermore, each hole 223 is a stepped hole and includes a wide portion 2232 and a narrow portion 2234. The wide portion 2232 is defined adjacent to the first surface 2212, while the narrow portion 2234 is defined adjacent to the second surface 2214. A size of the wide portion 2232 is greater than a size of the narrow portion 2234. The antenna module 100 is arranged on the first surface 2212 and the sidewall 222. In one embodiment, the antenna module 100 is a metal antenna pattern formed by laser-direct-structuring (LDS) technology.

Figure 4:
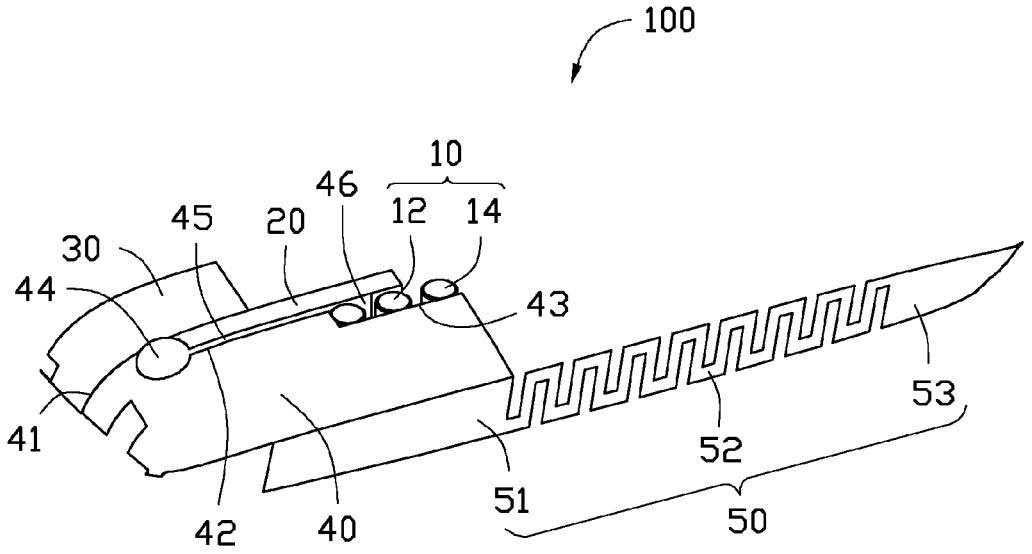
FIG. 4 is an isometric view of the antenna module shown in FIG. 1.

FIG. 4 shows the antenna module 100 connected to a plurality of connectors 10. The antenna module 100 includes a connecting portion 20, a first radiating portion 30, a second radiating portion 40, and an extending portion 50.

Figure 5:
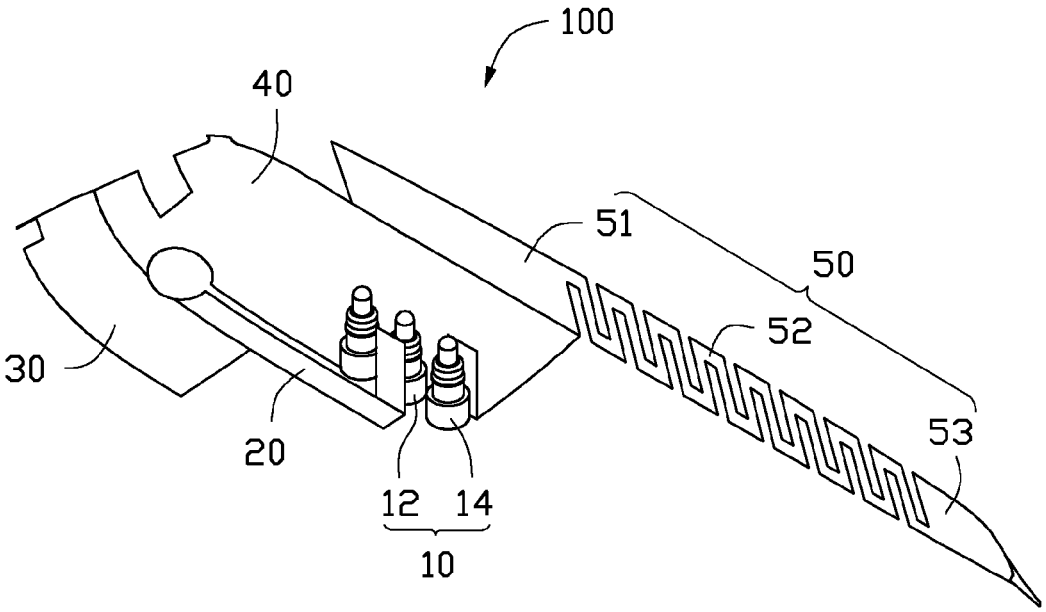
FIG. 5 is similar to FIG. 4, but viewed from another aspect.

FIG. 5 shows that each connector 10 is received in a corresponding hole 223. The second radiating portion 40 covers the first surface 2212. In the exemplary embodiment, the connectors 10 are pogo pins, and each connector 10 includes an elastic thimble portion 102, a narrow section 104, and a wide section 106. The elastic thimble portion 102 has a smaller diameter than the other parts of the connector 10. When the connectors 10 are received in the holes 223, the elastic thimble portion 102 of each connector 10 inserts through the narrow portion 2234 of the corresponding hole 223 and protrudes from the second surface 2214. The narrow section 104 of the connector 10 is received in the narrow portion 2234 of the hole 223, while the wide section 106 of the connector 10 is received in the wide portion 2232 of the hole 223. Thus, the connectors 10 are secured in the holes 223. When the housing 220 is assembled to a circuit board (not shown) of the wireless communication device 200, the elastic thimble portions 102 of the connectors 10 protruded from the second surface 2214 are electrically connected to the circuit board. The elastic thimble portions 102 of the connectors 10 are elastically deformed when resisting against the circuit board. Thus, the connectors 10 are more stably connected to the circuit board.

The plurality of connectors 10 include at least one feed portion 12 and at least one ground portion 14 for the antenna module 100. One end of the feed portion 12 is electrically connected to the connecting portion 20, while another end is electrically connected to a power point of the circuit board for feeding current to the first radiating portion 30 and the second radiating portion 40. One end of the ground portion 40 is electrically connected to the second radiating portion 40, while the other end is electrically connected to a ground point of the circuit board for grounding the antenna module 100.

The connecting portion 20 is substantially strip shaped. One end of the connecting portion 20 connects to the feed portion 12, while another end extends along a lengthwise direction of an arrangement of the connectors 10.

The first radiating portion 30 is an arcuate sheet and connects to a side of the connecting portion 20 away from the feed portion 12. An end portion of the first radiating portion 30 is arcuate to conform to an edge of the housing 220. A length of the first radiating portion 30 is shorter than a length of the connecting portion 20, and a width of the first radiating portion 30 is greater than a width of the connecting portion 20. The first radiating portion 30 is a high-frequency resonating element and receives current from the feed portion 12 via the connecting portion 20, thereby resonating and transceiving wireless signals at a first central frequency.

The second radiating portion 40 is an arcuate sheet and is connected to the first radiating portion 30. One end portion of the second radiating portion 40 connected to the first radiating portion 30 is arcuate to conform to the edge of the housing 220. A side edge of the second radiating portion 40 adjacent to the first radiating portion 30 is substantially step-shaped and includes a first side edge 41, a second side edge 42, and a third side edge 43. The first side edge 41 is connected to the first radiating portion 30. The second side edge 42 is spaced from and substantially parallel to the connecting portion 20, thereby defining a narrow groove 45. The third side edge 43 is spaced from and substantially parallel to the connecting portion 20, thereby defining a wide groove 46. An end of the wide groove 46 communicates with an end of the narrow groove 45. An end of the narrow groove 45 opposite from the wide groove 46 communicates with a circular hole 44 defined in the second radiating portion 40 and the first radiating portion 30. The circular hole 44 receives a fastening element to secure the antenna module 100 to the housing 220. A distance between the third side edge 43 and the connecting portion 20 is greater than a distance between the second side edge 42 and the connecting portion 20. In one embodiment, the plurality of connectors 10 is arranged in the wide groove 46, and the feed portion 12 is connected to the connecting portion 20, and the ground portion 14 is connected to the third side edge 43.

The extending portion 50 is connected substantially perpendicularly to a side of the second radiating portion 40 away from the first radiating portion 30. The extending portion 50 covers the sidewall 222. The extending portion 50 includes a first extending section 51, a second extending section 52, and a third extending section 53 connected in that order. The first extending section 51 is a substantially rectangular sheet and is connected substantially perpendicularly to the second radiating portion 40. The second extending section 52 is substantially square-wave shaped and extends from the first extending section 51. The third extending section 53 is blade-shaped and extends from the second extending section 52. The first extending section 51, the second extending section 52, and the third extending section 53 are substantially coplanar and extend along a same direction. The second radiating portion 40 is a low-frequency resonating element, the second radiating portion 40 and the extending portion 50 receive current from the feed portion 12 via the connecting portion 20 and the first radiating portion 30 and cooperatively resonate and transceive wireless signals at a second central frequency.

In other embodiments, shapes of the connecting portion 20, the first radiating portion 30, the second radiating portion 40, and the extending portion 50 can be adjusted according to different frequency band standards of signals to be transmitted or received.

In manufacture, the holes 223 are first defined collinearly in the housing 220. After that, the metal pattern of the antenna module 100 is formed on the housing 220 by LDS technology. Then, the connectors 10 are received in and secured in the corresponding holes 223, such that one end of the connectors 10 is electrically connected to the antenna module 100, while the other end protrudes from a surface of the housing 220. Finally, a circuit board is mounted to the housing 220, and the ends of the connectors 10 opposite from the antenna module 100 are electrically connected to the circuit board.

In other embodiments, the connectors 10 can be directly formed in the holes 223 by an insert molding technology. Then, the metal pattern of the antenna module 100 is formed on the housing 220 also by an insert molding technology and is electrically connected to the connectors 10.

The antenna module 100 is directly formed on the housing 220 and is electrically connected to the circuit board via the plurality of connectors 10. The elastic thimble portions 102 of the connectors 10 ensure a more stable connection with the circuit board. The connectors 10 are securely received in the holes 223 of the housing 220, which keeps the connectors 10 stably connected to the circuit board. Thus, a connection between the antenna module 100 and the circuit board via the connectors 10 is stable and durable. In addition, the antenna module 100 is operable at different frequency bands.

It is understood that the antenna module 100 may be formed on a holder which is a portion of a housing 220 of the wireless communication device 200.

It is believed that the exemplary embodiment and its advantages will be understood from the foregoing description, and it will be apparent that various changes may be made thereto without departing from the spirit and scope of the disclosure or sacrificing all of its advantages, the examples hereinbefore described merely being preferred or exemplary embodiment of the disclosure.

What is claimed is:

1. A wireless communication device comprising:

a housing comprising a bottom wall and a sidewall connected to the bottom wall, the bottom wall defining a plurality of holes; and a plurality of connectors correspondingly received and secured in the holes, each connector comprising an elastic thimble portion on one end; and an antenna module formed on the bottom wall and the sidewall, the antenna module comprising a connecting portion, a first radiating portion and a second radiating portion, the first radiating portion connecting to the connecting portion, the second radiating portion connecting to the first radiating portion and being parallel to the connecting portion;

wherein one end of the connectors connects to the antenna module, while the end with elastic thimble portion protrudes from the bottom wall for connecting to a circuit board;

wherein a side of the second radiating portion corresponding to the first radiating portion is step-shaped and comprise a first side edge, a second side edge, and a third side edge connected in order, the first side edge is connected to the first radiating portion, the second side edge and the third side edge are spaced from and parallel to the connecting portion, the plurality of connectors are arranged between the third side edge and the connecting portion, one of the connectors is connected to a side of the connecting portion opposite from the second radiating portion, another one of the connectors is connected to the third side edge;

wherein the antenna module comprises the extending portion perpendicularly connected to the second radiating portion and the extending portion is substantially parallel to the connecting portion;

wherein at least one connector connects to the connecting portion being a feed portion for the antenna module and at least one connector connects to the second radiating portion being a ground portion for the antenna module;

wherein the first radiating portion connects to a side of the connecting portion opposite to the feed portion, an end of the first radiating portion opposite to the connecting portion is substantially arcuate shaped;

wherein a distance between the third side edge and the connecting portion is greater than a distance between the second side edge and the connecting portion;

wherein the connecting portion and the second side edge define a narrow groove, the connecting portion and the third side edge define a wide groove, the narrow groove is in air communication with the wide groove, an end of the narrow groove opposite from the wide groove is in air communication with a circular hole defined in the second radiating portion and the first radiating portion for fastening the antenna module to the housing.

2. The wireless communication device as claimed in claim 1, wherein each hole is a stepped hole and includes a wide portion and a narrow portion, a size of the wide portion is greater than a size of the narrow portion; each connector includes the elastic thimble portion, a narrow section, and a wide section; the elastic thimble portion has a smaller diameter than other parts of the connector; the elastic thimble portion inserts through the narrow portion and protrudes from the second surface, the narrow section is received in the narrow portion, while the wide section is received in the wide portion.

3. The wireless communication device as claimed in claim 1, wherein the feed portion is connected to a side of the connecting portion opposite from the second radiating portion, the ground portion is connected to the third side edge.

4. The wireless communication device as claimed in claim 1, wherein the extending portion comprise a first extending section, a second extending section, and a third extending section connected in order, the first extending section perpendicularly connects to a side of the second radiating portion opposite to the first radiating portion, the second extending section is square wave shaped and extends from the first extending section, the third extending section is blade shaped and extends from the second extending section; wherein the first extending section, the second extending section, and the third extending section are collinear.

* * * * *